US006412139B1

(12) United States Patent
Weihrauch

(10) Patent No.: US 6,412,139 B1
(45) Date of Patent: Jul. 2, 2002

(54) METHOD FOR PRODUCING BRUSHWARE AND BRUSHWARE PRODUCING ACCORDING TO SAID METHOD

(75) Inventor: Georg Weihrauch, Wald-Michelbach (DE)

(73) Assignee: Coronet-Werke GmbH, Wald-Michelbach (DE)

( * ) Notice: Subject to any disclaimer, the term of this patent is extended or adjusted under 35 U.S.C. 154(b) by 0 days.

(21) Appl. No.: 09/647,204

(22) PCT Filed: Jun. 24, 1999

(86) PCT No.: PCT/EP99/04372

§ 371 (c)(1),
(2), (4) Date: Sep. 26, 2000

(87) PCT Pub. No.: WO00/01275

PCT Pub. Date: Jan. 13, 2000

(30) Foreign Application Priority Data

Jul. 4, 1998 (DE) ..... 198 29 943

(51) Int. Cl.[7] ..... A46B 9/04

(52) U.S. Cl. ..... 15/159.1; 15/167.1; 15/207.2; 300/21

(58) Field of Search ..... 15/167.1, 207.2, 15/DIG. 6, 159.1; D4/104, 136; 300/21

(56) References Cited

U.S. PATENT DOCUMENTS 4,802,255 A * 2/1989 Breuer et al.
5,268,005 A 12/1993 Suhonen
5,313,909 A * 5/1994 Tseng et al.

FOREIGN PATENT DOCUMENTS

| | | |
|---|---|---|
| DE | 34 00 941 | 10/1984 |
| DE | 42 93 451 | 4/1993 |
| DE | 195 34 368 | 3/1997 |
| EP | 0 303 202 | 2/1989 |
| FR | 2 622 779 | 5/1989 |
| GB | 1 076 967 | 7/1967 |
| GB | 2 137 080 | 10/1984 |
| WO | WO 94 10 539 | 5/1994 |

* cited by examiner

*Primary Examiner*—Terrence R. Till
(74) *Attorney, Agent, or Firm*—Paul Vincent

(57) ABSTRACT

In a method for the manufacture of brushware with plastic bristles, the bristles are extruded continuously as monofilaments, cut to the desired length and fixed to a bristle carrier as a bristle facing either individually or combined into groups. According to the invention, the monofilament after extrusion or the bristles produced therefrom are provided with at least one substantially linear boundary detectable on the bristle facing of the finished brushware as a color-contrasted marking at a distance from the use-side end of the bristles representing the use state. In brushware produced according to this method, at least part of the outer bristles in the bristle facing have a color-contrasted, substantially linear boundary at a distance from the use-side ends of the bristle representing the use state.

36 Claims, 6 Drawing Sheets

METHOD FOR PRODUCING BRUSHWARE AND BRUSHWARE PRODUCING ACCORDING TO SAID METHOD

PCT/EP99/04372. Translation of application as filed on Jun. 24, 1999.

BACKGROUND OF THE INVENTION

The invention relates to a method for the manufacture of brushware having plastic bristles, which are continuously extruded as monofilaments, cut to the desired length and fixed individually or in groups as a bristle facing to a bristle carrier. The invention also relates to the brushware manufactured according to the method.

Brushware, such as tooth, massage, paint, textile and carpet brushes, but also numerous technical and industrial brushes, only fulfil their use function over a specific period of time, which is almost exclusively determined by wear to the bristles and is otherwise dependent on the nature of the brushware and the desired working result.

For example, brushes used in the personal hygiene sector have a relatively short use period and include massage, cosmetic and in particular toothbrushes. Therefore the fundamental problem of the invention will be illustrated in exemplified manner relative to toothbrushes.

Even in the last century it was recognized in connection with toothbrushes (U.S. Pat. No. 74,560 of 1868), that bristles which, at the time were exclusively made from animal hair, have sharp edges or seams as a result of cutting processes and which can lead to injuries to the gingiva. In order to remove such edges and seams, toothbrush bristles, but also bristles for other brushes used on the human body, are rounded at the use-side ends by mechanical abrasion. U.S. Pat. No. 74,560 proposes a conical abrading or grinding with a rounded tip.

In recent times toothbrushes have almost exclusively had plastic bristles, which are cut to the desired length from extruded monofilaments. The short cuts obtained in this way are generally combined into bundles, which are then fixed to the toothbrush head. It is still necessary to round the use-side ends, which still mainly takes place by grinding or abrading. In the final state, the bristle has an identical, cylindrical cross-section over its length and is rounded to a dome-shaped tip at its use-side end. Of late, conical abraded bristles are used, so that at least individual bristles of the bristle facing better penetrate the interdental spaces and can also effectively clean fissures on the tooth surface. However, the bristle must still have a rounded tip, in order to prevent injuries to the gingiva or also, as recent scientific investigations have revealed, brush lesions to the tooth. This more particularly applies in the case of sensitive gingiva or dental necks, which exist in almost 50% of users.

For the aforementioned reasons, bristles are already used in toothbrushes which are extruded from plastics monofilaments, but which are split to so-called flags at their use-side ends. In the lower, unsplit region of the bristle, use is made of the desired bristle bending capacity, whereas the flags permit a careful cleaning of the tooth surfaces and inter-dental spaces, as well as a careful massaging action for the gingiva. Similar combinatorial effects are obtained with brushes, which comprise a core and a sleeve or shell, which are generally made from different plastics by co-extrusion. The core mainly meets the strength requirements, whereas the sleeve is responsible for the cleaning and hygienic function.

When a toothbrush is in regular use relatively rapidly bristle wear arises and as a result the bristles lose their aforementioned characteristics. Wear more particularly starts on the bristle jacket, so that cylindrical bristles are tapered towards the bristle end and bristles with a conical end are pointed after a certain period of use. In both cases the round tip is worn away, usually in an irregular manner, so that the effects sought by the rounding are lost. In the case of bristles comprising a core and a sleeve, initially the sleeve is worn away in the vicinity of the bristle end and the core is exposed. In the case of bristles with flags, the wear progresses even faster due to the thin cross-sections of the flags. Since this leads to a constant decrease in the free length of the flags, conversely there is an undesired increase to their rigidity and there is a risk of the solid bristle stump causing injury.

For the aforementioned reasons dentists recommend the replacement of toothbrushes after a few weeks. The user frequently fails to do this, because it is impossible to optically perceive wear as a result of the limited bristle cross-sections, which are between 0.15 and 0.225 mm and even after a long period of use the toothbrush gives the optical appearance of still being usable.

Numerous attempts have been made to render visible to the user the degree of wear of a toothbrush. Thus, it is known (EP 366 100) to construct part of the toothbrush handle from a material which discolors or even dissolves as a result of use, so that in the first case it is rendered optically visible to the user and in the second through the non-usability of the handle that the toothbrush must be replaced. However, understandably, such a design is completely practically inappropriate.

According to another known proposal the bristle is made from a core and a jacket with a different color. As a result of the abrading action occurring on brushing, in the vicinity of the use-side ends the jacket is worn away and consequently the differently colored core material becomes visible, so that the user is made optically aware of the need to replace the toothbrush (DE 34 00 941, U.S. Pat. No. 4,802,255, 5,313, 909, 5,268 005, WO94/10 539). Bristles of this type have already entered practical use, because no other appropriate solutions exist. However, the amount of wear is not apparent in a not with sufficiently high contrast manner to lead the user to replace the toothbrush at the correct time. The reproducibility of such a use indication is also inadequate. Frequently such an optical indication, only rendered visible by wear to the bristle, is only noticed at a late time or not at all. This method also presupposes a two-part bristle construction of core and sleeve.

This method fails in the case of modern bristle shapes, e.g. with a conical tapering bristle end, because either the jacket and therefore the entire bristle must have an excessive cross-section, or the core must be differently colored over its length, which is not technically possible by extrusion. This method also fails with bristles having flags or with brushes in which the use-side ends of the bristles are in a non-planar envelope or envelope surface.

The problem of the present invention is to continuously provide the brushware user with optical information concerning the existing use state and the degree of wear independently of the actual abrasion situation when using the brushware.

SUMMARY OF THE INVENTION

According to the invention, this problem is solved in that the monofilament after extrusion or the bristles produced therefrom is provided with at least one substantially linear boundary detectable on the bristle facing of the finished brushware as a color-contrasted marking, at a distance from the use-side end of the bristles representing the use state.

Thus, with the method according to the invention, the marking indicating the degree of use or the need to replace the brush is applied subsequently, namely after extrusion, to the monofilament or the cut-to-size bristle, in the form of a color-contrasted, linear boundary, which has a distance from the use-side end of the bristle representing the use state and therefore the degree of wear. This distance, i.e. the position of the boundary, can be fixed according to substantially objective criteria, in that the finished brushware undergoes a long-term or endurance test and the nature and extent of the wear is macroscopically investigated on the individual bristles. On the basis of the average values of the bristle wear of the entire bristle facing obtained in this way, it is possible to establish the particular bristle length, in which disadvantageous wear or abrasion phenomena for the correct function of the brush appear. Correspondingly the boundary is then applied to the monofilament or bristle.

With the method according to the invention it is possible to provide with a use indication bristles having random shaping such as single-element monofilaments, multiple-element monofilaments, co-extruded monofilaments, bristles with flags or conical tapering bristle ends, which is clearly perceptible to the user and is not dependent on the abrasion situation. On the finished brushware, it is only necessary to provide individual bristles or individual bristles within several bundles with the color-contrasted marking, in order to indicate the degree of wear. These bristles or bundles will in particular be provided in the brush areas where, on the basis of the endurance tests, wear progresses fastest. Use will only be made for the application of the boundary of those bristles which are on the outside in the bristle facing, which offers the advantage that the marking or boundary can also be subsequently applied to the finished brush.

It is also possible to provide several color-contrasted, substantially parallel, linear boundaries at different distances from the use-side end of the bristles, so as to represent different use states for different stages of wear.

This method is particularly suitable for brushware, where micro-range wear does not lead to the bristles becoming unusable and more particularly for brushware where the functional quality merely decreases with increasing shortening of the bristles, e.g. the bristles become stiffer through shortening and consequently the brush becomes harder, or the absorption of the bristle facing for the application media decreases due to the shorter capillaries between the bristles. For such brushware it is largely up to the user to decide the time or wear state when the brush no longer satisfies his individual requirements.

The linear boundaries can be formed by the boundary lines of strip-like markings and it is possible to apply several strip-like markings of different width for indicating different use states.

As has already been indicated, the boundary on the monofilament can be produced after extrusion, e.g. in intervals or distances following the subsequent bristle length. However, the boundary can also be applied to the finished bristle after cutting to size, but preferably the boundary is produced on the outer bristles of the bristle facing before of after the fixing thereof to the bristle carrier. In the first-mentioned case, the bristle facing is fixed in a holder in the final configuration of the bristles or bundles (e.g. EP 346 646) and transferred with the holder to the brush manufacturing machine. It is preferably an injection mould, in which the bristle carrier plastics material is molded round the bristle facing at the fixing-side ends of the bristles. In this variant of the method, as for the marking of the bristles on the finished brushware, the boundary can be applied very simply and very precisely on the basis of the results obtained in the endurance tests. It can also be locally precisely defined should this prove necessary and as a result of the close juxtaposition of the bristles there is generally no need for each outer bristle to carry a marking, because the marking applied to several bristles over the entire extension of the bristle facing is optically visible as a linear or strip-like boundary. This more particularly applies for boundaries, which are produced in the form of dots or strips or as part of a circumferential line on the bristles.

Finally, this method variant has the advantage that different technical methods can be utilized for applying the marking and further reference will be made thereto hereinafter.

In the case of toothbrushes the bristle facing is frequently contoured, in order to adapt the brush face to the contours of the denture, teeth or mouth. Therefore the use-side ends of the bristles are in an envelope diverging from the plane. For such brushes, particularly toothbrushes, according to the invention the boundary is applied in a preferably parallel position corresponding to said envelope.

Thus, it is ensured that even for brushes having an irregular contour, the use state of the brush or the degree of wear of the bristles can be seen at all times in all areas of the bristle facing. For brushes of this type, the bristles or bundles need only be finished in the manner according to the invention in those areas where the greatest wear is observed.

The boundary can also be produced by the boundary line of differently colored zones in the longitudinal direction of the bristles, which can be obtained by subsequent treatment using physical processes.

For bristles comprising a core and a sleeve, e.g. produced by co-extrusion, the boundary can be produced on the core, sleeve or both, in order to indicate different use states or degrees of wear. For example, the core can be provided with a boundary having a smaller distance from the use-side end than a marking applied to the sleeve. In the case of jacket material removal caused by use, initially the marking applied to the core is exposed, in order to e.g. indicate to the user that wear has reached a significant level, whereas the marking made on the sleeve indicates to the user that the brush should be replaced. This construction is particularly recommended for those brushes, whose sleeve contains fillers, e.g. those having an abrasive action.

The sleeve can be made from a transparent plastic and the core can be provided with a translucent boundary. During brush use, the boundary is constantly perceptible with a specific color intensity. If during use the jacket is removed, the boundary finally appears with a possibly more intense color, in order to bring about a brush replacement on the part of the user.

According to a preferred development, the monofilament used for producing the bristles is extruded from a pigment-filled plastic, which reacts to laser beams with a color change, the boundary being produced by the action of laser beams on the monofilament or the bristles produced therefrom.

Laser technology is particularly suitable in the method according to the invention, because the marking is not only produced on the surface, but also in the depth of the monofilament or bristles. The marking can also be precisely defined and localized by the parallel-beam laser light. It is also possible to influence the depth of the marking by the laser parameters. In the case of two or multiple-element bristles, it is also possible to use a pigmented monofilament for a single element, so that only the latter is marked. For a monofilament comprising a core and a sleeve, only the core or only the sleeve need be filled with pigments, in order to apply the marking either to the sleeve or to the core. If both are filled with pigments, markings can be applied to the sleeve and the core for indicating different use states.

It is also possible to extrude the monofilament from two polymers with different laser beam absorption coefficients. In this case a pigmentation is unnecessary and marking mainly takes place by color change at the interface to the more strongly absorbing polymer. If both polymers are co-extruded to a monofilament, the color change need only take place at the interface of core and sleeve.

Laser technology offers the particular advantage that the uneven lateral face of the bristle facing formed from a plurality of juxtaposed, standing bristles and which is therefore in the form of an irregularly corrugated envelope of the outer bristle jackets can still be provided with an optically closed-appearing marking. Laser technology also offers the possibility of applying an explanatory inscription below and in the same way as the boundary rendering the user state legible to the user.

The ink jet process can be used in place of laser technology for applying the boundary and in it the ink applied penetrates the micro-pores of the bristle surface. Other processes with a similarly precise dye or color application can be used.

Instead of this, the monofilament can be extruded with a thin, chromophoric top coat and the boundary is produced by the removal of the top coat. This removal can once again take place by laser beams.

The invention also relates to the brushware manufactured according to the aforementioned methods, which are characterized in that at least part of the outer bristles in the bristle facing have a color-contrasted, substantially linear boundary in a distance from the use-side end of the bristle representing the use state.

Embodiments of such brushware are characterized in claims 22 to 36.

BRIEF DESCRIPTION OF THE DRAWING

The invention is described in greater detail hereinafter relative to embodiments of brushware and the attached drawings, wherein show.

DESCRIPTION OF THE PREFERRED EMBODIMENT

Figure 1:
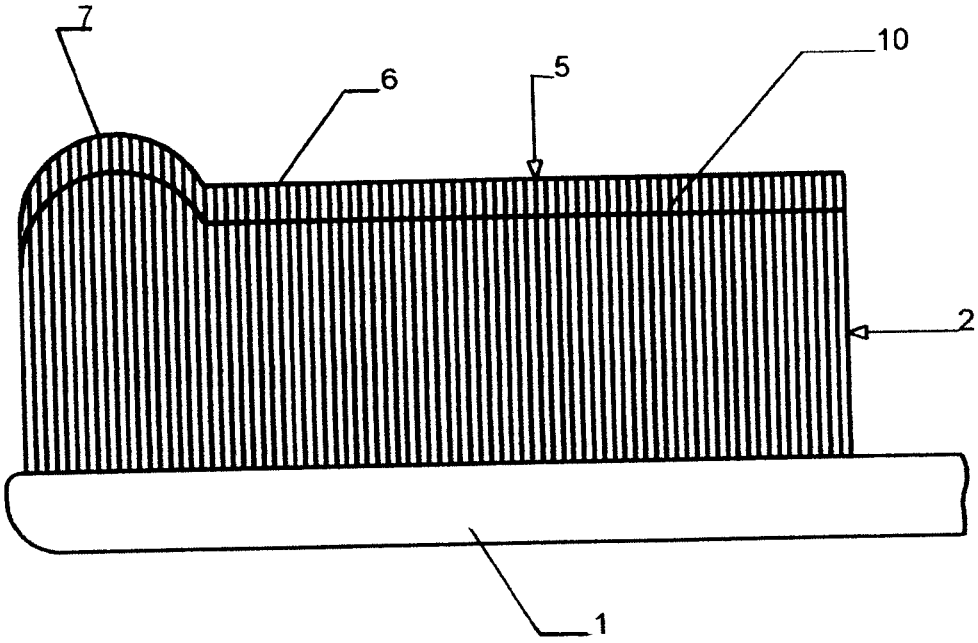
FIG. 1: A diagrammatic side view of a brush with contoured surface.
Figure 2:
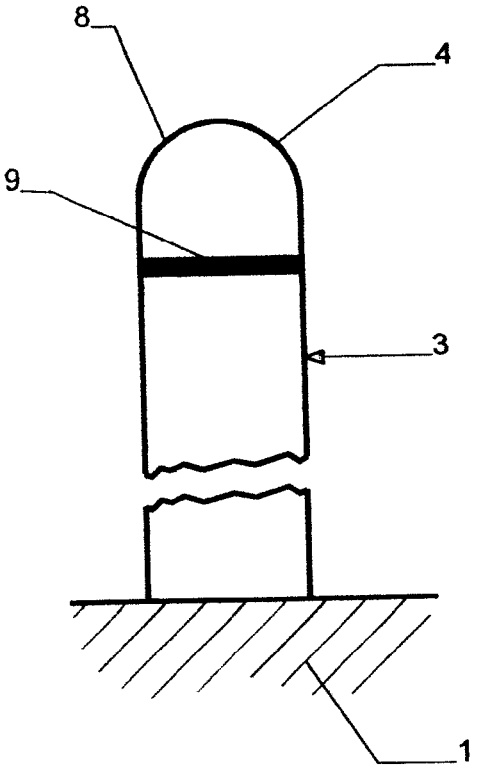
FIG. 2: A view of an individual bristle of the brush according to FIG. 1 in the new state.
Figure 3:
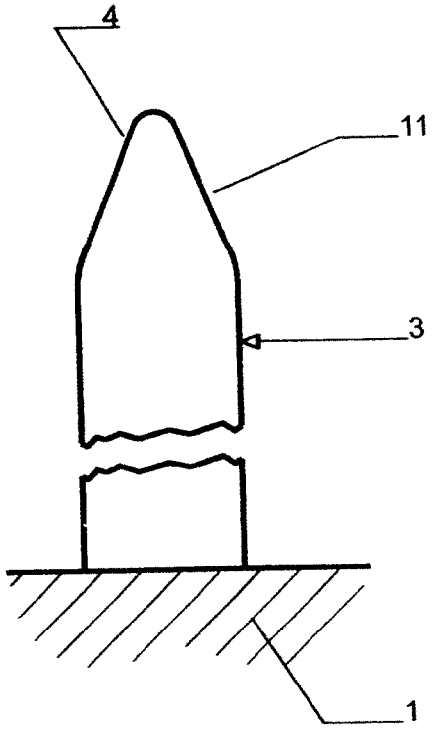
FIG. 3: The bristle according to FIG. 2 after prolonged brush use.

The brush according to FIG. 1 comprises an e.g. plastic carrier 1, to which is fixed a bristle facing 2 which, in the represented embodiment, consists of a plurality of bristle bundles indicated by single broken lines in the drawing. Each bundle has several bristles 3, whereof one is shown in FIGS. 2 and 3. The use-side bristle ends 4 are on an envelope or envelope surface 5, which diverges from the plane. In the specific case it has a planar portion 6 and a curved portion 7. This can e.g. be the head of a toothbrush.

As shown in FIG. 2, in the unused state the bristle 3 has at its use-side end 4 a dome-like, rounded tip 8. Spaced from the tip 8 is applied to the outer bristles within the facing 2 a linear boundary 9, which represents the use state of the bristle. This boundary 9 can e.g. be applied by a laser beam. For this purpose the bristles 3 or the extruded monofilament from which they are produced by cutting to size, can be filled with pigments, which absorb the laser beams.

In the unused state the boundary 9 is optically clearly visible as a marking line. This marking line 9 applied to the outside of the outer bristles is revealed on the entire bristle facing, even if it comprises individual bundles, as a substantially closed marking line 10.

In toothbrushes the outer bristles of the bristle facing 2 are stressed to the greatest extent. Thus, wear starts on these in such a way that the plastic is initially worn away on the jacket of the bristle 3, so that its use-side end 4 gradually tapers to a more or less regular cone 11. The dome-shaped tip 8 is lost and consequently the bristle becomes more aggressive. During said wear the marking 9 is finally reached and disappears on further brush use, as can be seen in FIG. 3. Due to the distance of the boundary 9 from the dome-shaped tip 8, it is possible to fix a degree of wear at which the toothbrush should be discarded. This is recommended when the marking boundary 9 has disappeared on a few bundles.

Combined with the distance of the boundary 9 from the dome-shaped tip 8, it is also possible to use for indicating the degree of wear the depth of the boundary 9 controllable by laser parameters.

The boundary 9 is preferably established by means of endurance tests on the brush with macroscopic testing of the wear or abrasion phenomena on the individual bristles. On the basis of such wear measurements, in the case of the envelope 6 visible in FIG. 1, the marking line 10 can be formed parallel to the envelope 5 of the use-side ends or in the case of non-uniform wear in different areas also with a different line pattern.

Figure 4:
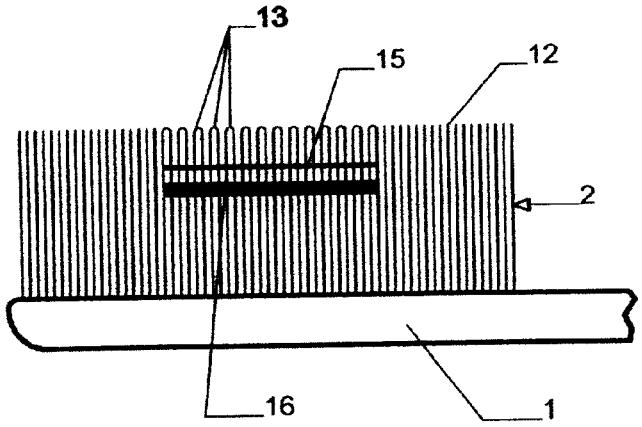
FIG. 4: A side view of another embodiment in the unused state with a bristle facing comprising different bristles.
Figure 5:
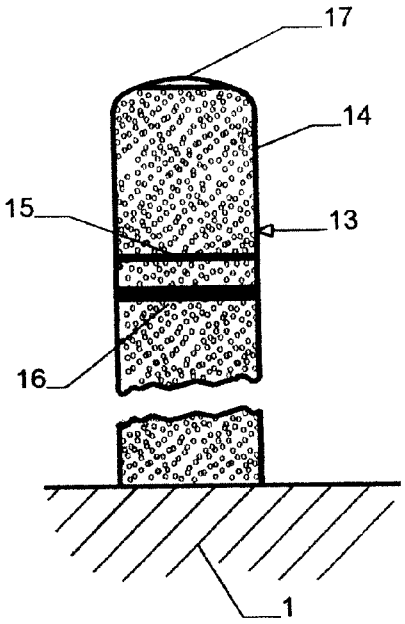
FIG. 5: A larger-scale view of a single bristle from the bristle facing of FIG. 5 in the unused state.
Figure 6:
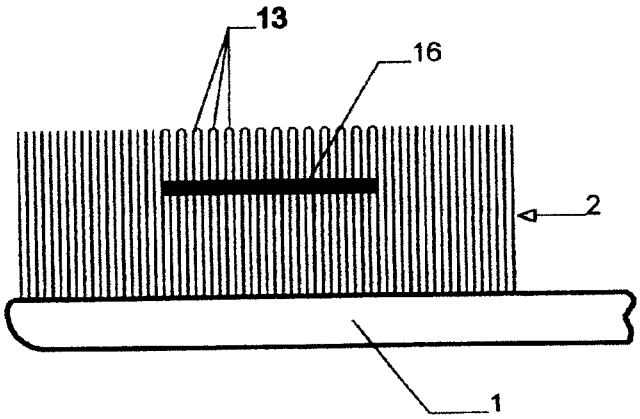
FIG. 6: The brush according to FIG. 4 after prolonged use.
Figure 7:
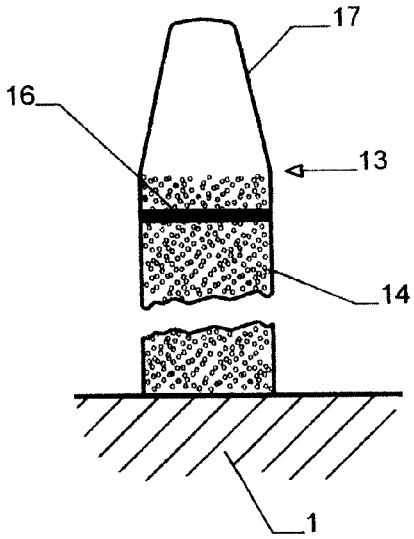
FIG. 7: The bristle according to FIG. 5 after prolonged use.

In the embodiment according to FIG. 4 the bristle facing 2 fixed to the bristle carrier 1 comprises bristles (indicated by parallel dashes) combined into bundles 12 and optionally stronger single bristles 13, whose surface 14 (FIG. 5) is e.g. structured in order to produce an abrasive action. The brush according to FIG. 4 or the abrasively acting bristles 13 only fulfil their function for as long as the structured circumferential surface 14 is active. In the embodiment on the outer single bristles 13 are formed two linear boundaries 15, 16 at different distances from the rounded, use-side end 17 of the bristles. The boundary 15 serves as a prior warning, whereas the boundary 16 represents a degree of wear at which the brush should be discarded. This state is shown in FIGS. 6 and 7. FIG. 7 shows that as a result of the wearing away of the plastic on the jacket of the bristle 13, the use-side end has worn to a conical end 17, where the structured surface 14 (FIG. 5) has disappeared. If as a result of increasing abrasion the first, prior warning marking 15 disappears with only the wider marking 16 being visible, the brush should be replaced. Also in the embodiment the marking boundaries 15, 16 are applied by laser beams to the outer jacket of the outer bristles of the bristle facing 2. Here again the bristles 13 can be filled with a suitable pigment.

Figure 8:
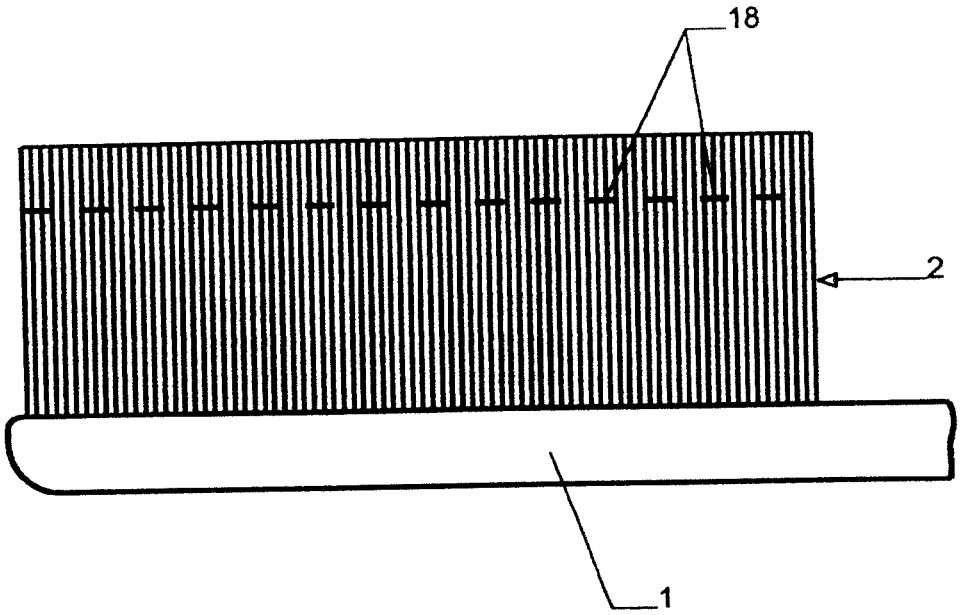
FIG. 8: A schematic side view of another embodiment of a brush in the unused state with a different bristle facing.
Figure 9:
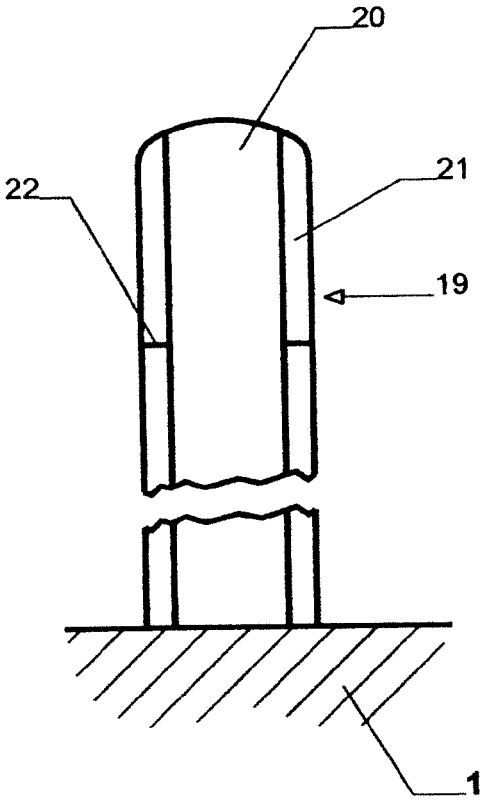
FIG. 9: A larger-scale longitudinal section through a two-component bristle from the bristle facing according to FIG. 8 in the unused state.
Figure 10:
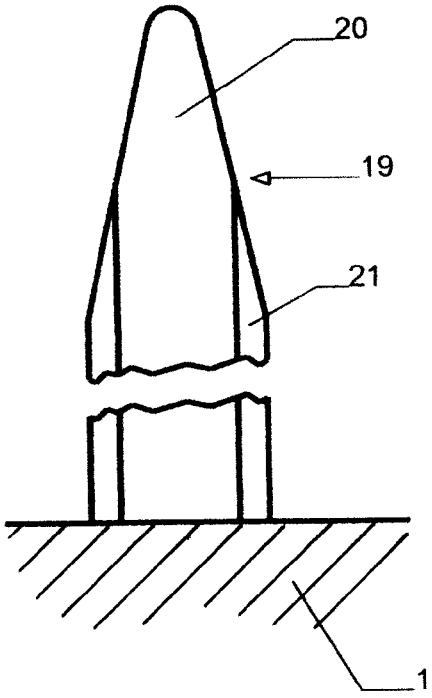
FIG. 10: The bristle according to FIG. 9 after prolonged use.

In the embodiment of FIG. 8 the bristle facing 2 once again comprises bundles indicated by dashes. On the outer bristles of at least some bundles are once again applied marking boundaries 18, which optically appear as an interrupted line.

Each individual bristle 19 of the bristle facing 2 comprises a core 20 and an envelope 21, which are e.g. made from different polymers or from the same polymers, whereof the polymer forming the envelope 21 is filled with pigments.

To the sleeve 21 of the outer bristles 19 of the bristle facing 2 is once again applied a boundary 22, preferably by lasers. A portion of the interrupted line 18 indicates the boundary 22 of adjacent bristles in a bundle. During use the bristle 19 is also conical tapered, i.e. firstly the envelope 21 and then also the core 20 are worn away. The boundary 22 once again indicates the degree of wear when the brush should be discarded and at which the marking boundary 22 gradually disappears.

Figure 11:
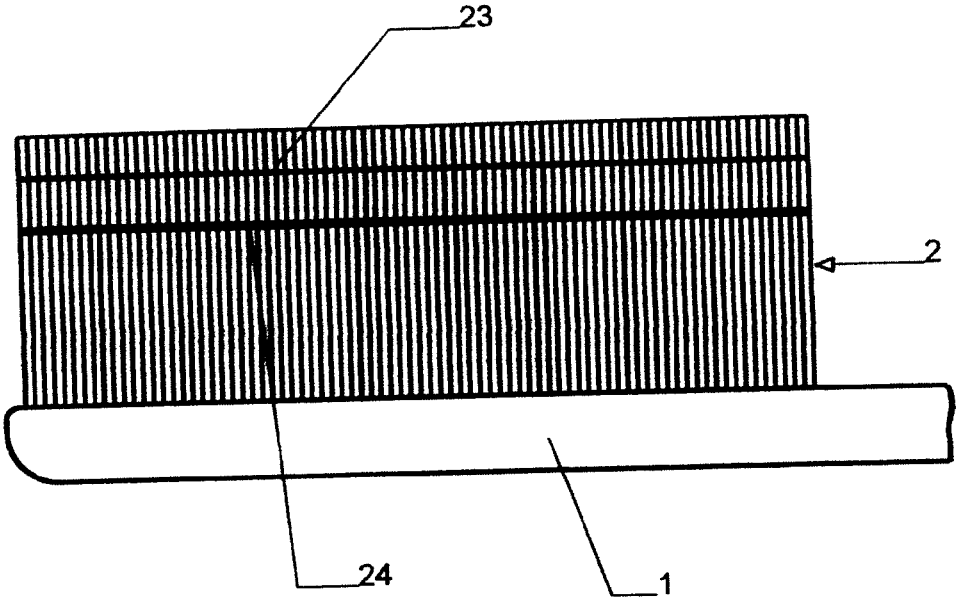
FIG. 11: A schematic side view of another embodiment of a brush in the unused state.
Figure 12:
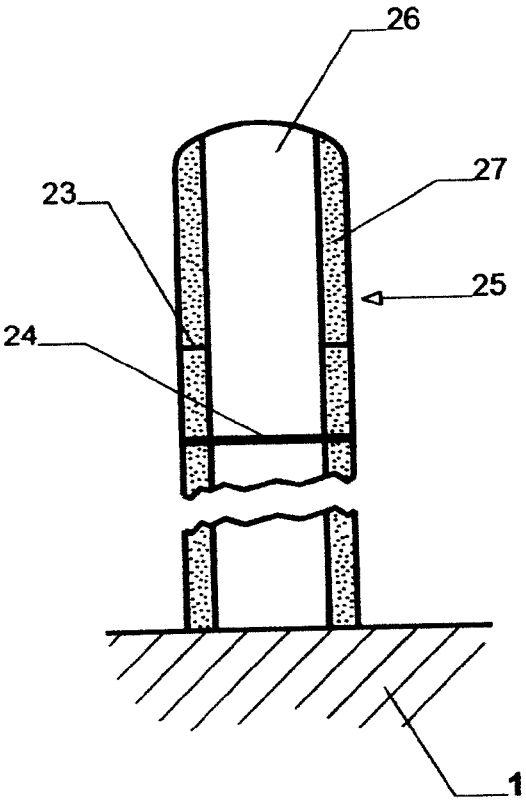
FIG. 12: A longitudinal section through an unused bristle from the bristle facing of FIG. 11.
Figure 13:
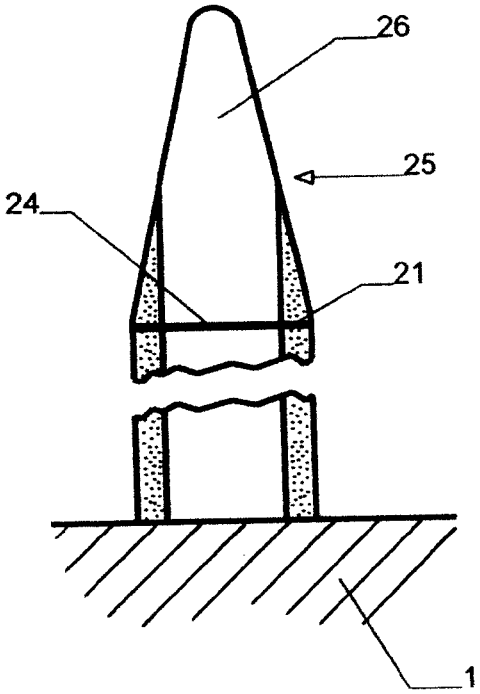
FIG. 13: The bristle according to FIG. 12 after prolonged use.

In the embodiment according to FIG. 11 the bristle facing once again comprises bundles, whose outer bristles have two marking boundaries 23, 24 having an optionally differing thickness or intensity. The bristle facing 2 comprises abrasively acting bristles 25, as shown in FIGS. 12 and 13. It once again comprises a core 26 and a sleeve 27 forming the jacket. They are rounded at their use-side ends. The plastic forming the sleeve 27 is filled with abrasively acting particles. The marking boundary 23 is only applied to the sleeve 27, whereas the marking boundary 24 is provided both on the sleeve 27 and the core 26. With correspondingly pigmented plastics, this e.g. takes place by setting the laser beam penetration depth.

When the bristle according to FIG. 12 is worn, the abrasive sleeve 27 is initially abraded away and gradually the upper boundary 23 disappears. As a function of the quality requirements made on the brush by the user, he will discard the brush at this use state. When lower quality demands are set, he can use the brush until the boundary 24 is reached or disappears. At this time wear has advanced to such an extent that damage can occur to the object treated with the brush.

Figure 14:
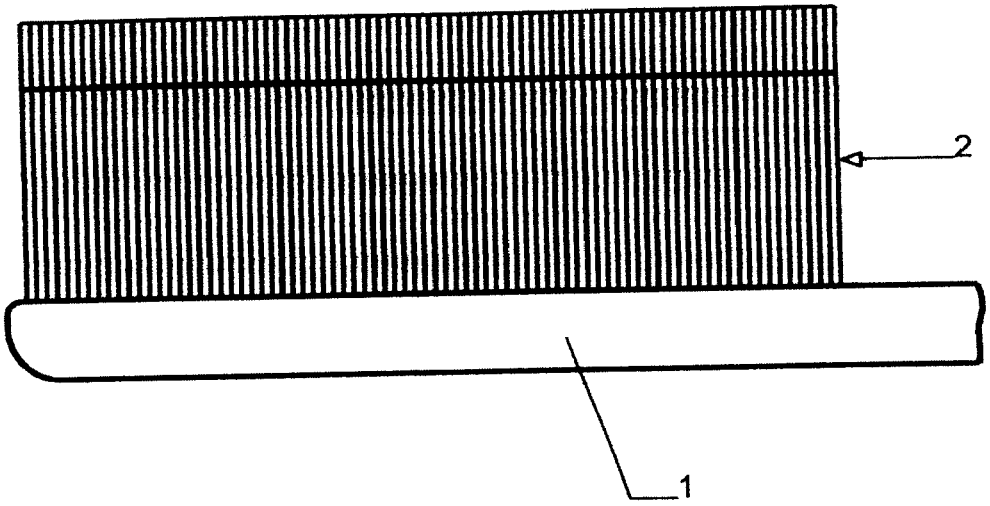
FIG. 14: A schematic side view of another variant of a brush in the unused state.
Figure 15:
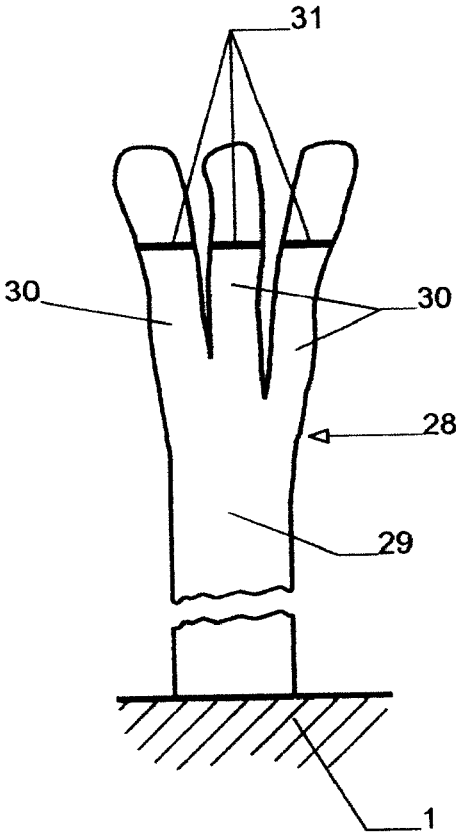
FIG. 15: A larger-scale view of a bristle from the bristle facing of FIG. 14 in the unused state.
Figure 16:
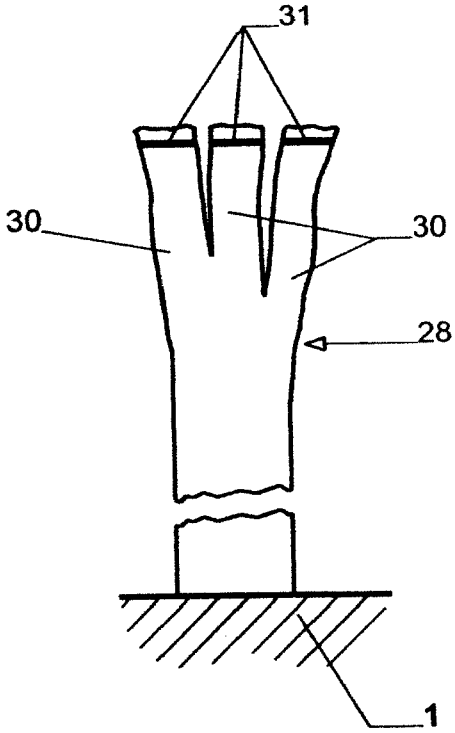
FIG. 16: The bristle of FIG. 15 after prolonged use.

FIG. 14 shows an embodiment in which the bristle facing comprises flagged bristles 28, which have a solid bristle shaft 29, which is split to individual flags 30 at the use-side end. These flags 30 ensure a careful treatment during the brushing process. Due to their smaller cross-section they only have a limited wear-resistance. To ensure the careful treatment, it is necessary to replace the brush when the flags 30 have worn to a relatively limited extent. Thus, to the flags 30 of the outer bristles in the bristle facing 2 linear boundaries 31 are applied, e.g. by lasers and ensure that the flags 30 are still present over a partial length (FIG. 16), when the user is informed that the use period is reached by the marking boundary 31.

Figure 17:
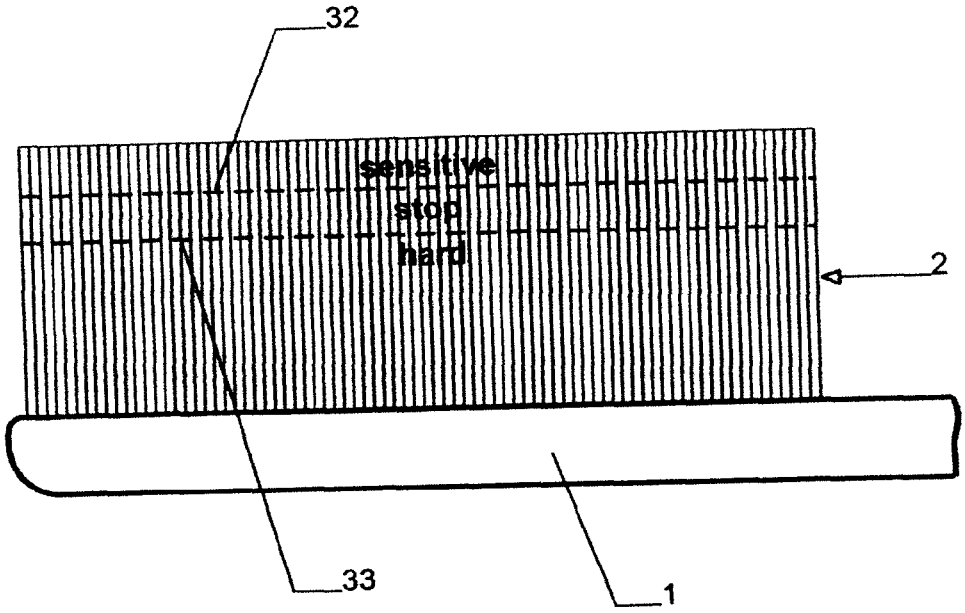
FIG. 17: A schematic side view of another embodiment of a brush in the unused state.

In the embodiment according to FIG. 17 the bristle facing 2 has, in addition to the marking, linear boundaries 32, an inscription indicating the use state. The word "sensitive" indicates a careful, soft action of the bristles, which no longer exists on reaching the boundary 32 with the inscription "stop". The user able to accept a somewhat harder bristle action, has his attention drawn to this circumstance by the second marking boundary 33 with the inscription "hard".

Figure 18:
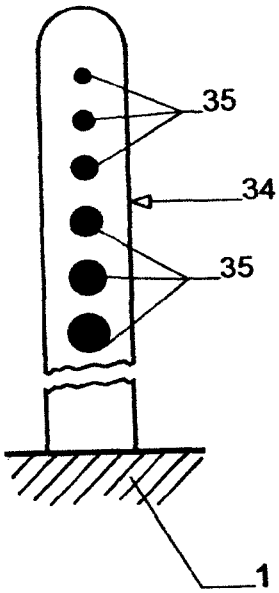
FIG. 18: A side view of another embodiment of a bristle.

FIG. 18 shows an embodiment of a bristle 34, to whose jacket have been applied dot-shaped markings 35 with an increasing surface area. On the finished bristle facing they form strip-like markings of differing width and can in particular indicate different degrees of wear on industrial brushes or the like, which are manifested by increasing bristle facing hardness.

Figure 19:
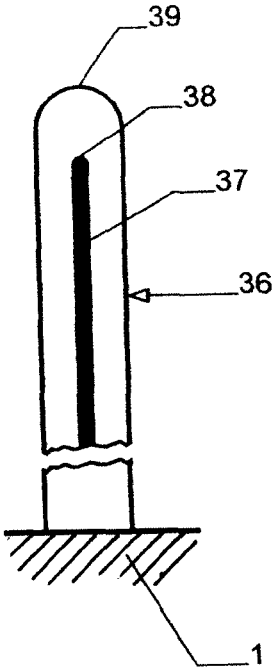
FIG. 19: A side view of bristle in another variant.

In the embodiment of a bristle 36 shown in FIG. 19, to its jacket is applied a strip-like marking 37, whose upper end 38 is spaced from the use-side bristle end 39. This upper end 38 of the marking 37 forms a linear boundary in the complete bristle facing. The user is informed of the degree of wear in this case by the fact that the outer bristles have a light color on their use-side ends. If the wear reaches the upper ends 38 of the marking, the entire bristle facing appears dark, which indicates to the user that the brush should be replaced.

I claim:

1. A method for the manufacture of brushware having plastic bristles made from continuously extruded monofilaments which are cut to a desired length and fixed to a bristle carrier either individually or in combined groups, to form a bristle facing, the method comprising:

providing one of the monofilament and the bristles with at least one substantially linear boundary which is visible on the bristle facing of the brushware as a color-contrasted marking, said linear boundary disposed at a distance from a use-side end of the bristles to indicate a use state thereof.

2. The method of claim 1, wherein one of the monofilament and the bristles is provided with a plurality of boundaries disposed in a spaced apart manner to indicate differing use states.

3. The method of claim 1, wherein said at least one linear boundary comprises boundary lines of strip-like markings.

4. The method of claim 3, wherein said strip-like markings having differing widths to indicate differing use states.

5. The method of claim 1, wherein said boundary is produced on outer bristles of the bristle facing.

6. The method of claim 5, wherein said boundary is produced by boundary lines of differently colored zones in a longitudinal direction of the bristles.

7. The method of claim 1, wherein use-side ends of the bristles in the bristle facing are disposed in a non-planar envelope, and wherein said boundary is disposed to correspond with said non-planar envelope.

8. The method of claim 1, wherein said boundary comprises one of dots and strips disposed on the bristles to form linear boundaries on the brushware.

9. The method of claim 1, wherein said boundary is produced on part of a circumference of the bristles.

10. The method of claim 1, wherein the bristles comprise a core and a sleeve, and wherein said boundary is fashioned on at least one of said core and said sleeve.

11. The method of claim 10, wherein said core comprises a core polymer having a core pigmentation and said sleeve comprises a sleeve polymer having a sleeve pigmentation, said sleeve pigmentation differing from said core pigmentation.

12. The method of claim 10, wherein said core has a core boundary and said sleeve has a sleeve boundary, said core boundary having a smaller distance from the use-side end than said sleeve boundary.

13. The method of claim 10, wherein said sleeve is formed from a transparent plastic and said core is provided with a translucent boundary.

14. The method of claim 1, wherein the monofilament is extruded from a pigment-filled plastic, said pigment reacting to laser beams with a color change, wherein said boundary is produced by an action of laser beams on one of the monofilament and the bristles produced therefrom.

15. The method of claim 14, wherein a marking depth of said boundary is controlled by laser parameters.

16. The method of claim 1, wherein the monofilament is extruded from two polymers having differing laser light absorption coefficients, wherein said boundary is produced by an action of a laser beam on one of the monofilament and the bristles produced therefrom.

17. The method of claim 1, wherein said boundary comprises ink applied by an ink jet process to one of the monofilament and the bristles produced therefrom.

18. The method of claim 1, wherein the monofilament is extruded with a thin, chromophoric top coat, wherein said boundary is produced by removing said top coat.

19. The method of claim 18, wherein said top coat is removed by laser beams.

20. The method of claim 1, further comprising an explanatory inscription disposed below said boundary.

21. A brushware comprising:

a bristle carrier; and a bristle facing fixed to said bristle carrier, said bristle facing formed from individual or group-wise combined bristles, wherein at least part of outer bristles in said bristle facing have at least one color-contrasted, substantially linear boundary at a distance from use-side ends of said bristles, said boundary indicating a use state of said bristles.

22. The brushware of claim 21, wherein said bristles have a plurality of mutually spaced, linear boundaries to indicate differing use states.

23. The brushware of claim 21, wherein said linear boundary is formed by boundary lines of strip-like markings.

24. The brushware of claim 23, wherein a plurality of strip-like markings have increasing widths at increasing distances from said use-side ends.

25. The brushware of claim 21, wherein said use-side ends of said bristles in said bristle facing are disposed in a non-planar envelope, wherein said linear boundary is disposed in correspondence with said envelope.

26. The brushware of claim 21, wherein said linear boundary on said bristle facing comprises one of dot-shaped and linear markings.

27. The brushware of claim 21, wherein said boundary is formed by a boundary line of differently colored zones of said bristle.

28. The brushware of claim 21, wherein said bristles comprise a core and a sleeve, wherein said boundary is disposed on at least one of said sleeve and said core.

29. The brushware of claim 28, wherein said core and said sleeve are at least one of made from different polymers and filled with different pigments.

30. The brushware of claim 28, wherein said core has a core boundary and said sleeve has a sleeve boundary, said core boundary being closer to said use-side ends of said bristles than said sleeve boundary.

31. The brushware of claim 28, wherein said sleeve is made from transparent plastic and said core is provided with a translucent boundary.

32. The brushware of claim 21, wherein said bristles comprise a pigment-filled polymer which reacts to laser light with a color change.

33. The brushware of claim 21, wherein said boundary is applied to said bristles using an ink jet process.

34. The brushware of claim 21, wherein said bristles have a thin, chromophoric top coating which is interrupted in a region of said boundary.

35. The brushware of claim 21, wherein said bristles are split to flags at said use-side ends and wherein said boundary is disposed on said flags.

36. The brushware of claim 21, further comprising an inscription explaining a use state, said inscription disposed below and proximate to said boundary.

* * * * *